US007913722B2

(12) United States Patent
Dorst

(10) Patent No.: US 7,913,722 B2
(45) Date of Patent: Mar. 29, 2011

(54) WATERCRAFT FUELING APPARATUS AND METHODS

(76) Inventor: Alex W. Dorst, Scottsdale, AZ (US)

( * ) Notice: Subject to any disclaimer, the term of this patent is extended or adjusted under 35 U.S.C. 154(b) by 967 days.

(21) Appl. No.: 11/745,393

(22) Filed: May 7, 2007

(65) Prior Publication Data

US 2008/0276853 A1 Nov. 13, 2008

(51) Int. Cl.
*B60K 15/04* (2006.01)

(52) U.S. Cl. ..... 141/86; 141/311 A; 141/326; 220/86.1; 220/573; 137/312

(58) Field of Classification Search ..... 141/5, 86, 141/326, 349, 350, 311 A; 220/86.2, 573; 137/312

See application file for complete search history.

(56) References Cited

U.S. PATENT DOCUMENTS

| | | | | | |
|---|---|---|---|---|---|
| 3,467,274 | A | | 9/1969 | Schmitt | |
| 3,802,596 | A | | 4/1974 | Schmidt | |
| 4,013,105 | A | * | 3/1977 | Uuskallio | 141/86 |
| 4,520,852 | A | * | 6/1985 | Klein | 141/86 |
| 4,630,749 | A | | 12/1986 | Armstrong et al. | |
| 4,793,387 | A | | 12/1988 | LeBlanc et al. | |
| 4,816,045 | A | | 3/1989 | Szlaga et al. | |
| 4,842,443 | A | | 6/1989 | Argandona | |
| 5,062,541 | A | | 11/1991 | Galbo | |
| 5,322,099 | A | * | 6/1994 | Langlois | 141/86 |
| 5,469,800 | A | * | 11/1995 | Brotz | 141/86 |
| 5,503,199 | A | | 4/1996 | Whitley, II et al. | |
| 5,507,324 | A | * | 4/1996 | Whitley et al. | 220/86.2 |
| 5,662,149 | A | * | 9/1997 | Armellino | 141/86 |
| 5,727,603 | A | * | 3/1998 | Langlois | 141/1 |
| 5,865,222 | A | * | 2/1999 | Diamond | 141/311 A |
| 5,878,795 | A | * | 3/1999 | Armellino | 141/86 |
| 5,894,809 | A | | 4/1999 | Grigaitis et al. | |
| 5,899,249 | A | * | 5/1999 | Armellino | 141/86 |
| 5,950,688 | A | * | 9/1999 | Langlois | 141/86 |
| 6,237,645 | B1 | | 5/2001 | Pountney | |
| 6,655,418 | B1 | * | 12/2003 | McGill et al. | 141/86 |
| 6,698,468 | B1 | | 3/2004 | Thompson | |
| 6,929,039 | B2 | * | 8/2005 | Vaitses | 141/311 A |
| 6,976,513 | B2 | | 12/2005 | Schlachter | |
| 7,073,681 | B2 | * | 7/2006 | Abe et al. | 220/375 |
| 7,360,565 | B2 | * | 4/2008 | Peterson et al. | 141/326 |
| 2007/0261757 | A1 | * | 11/2007 | Smith et al. | 141/59 |

* cited by examiner

*Primary Examiner* — Timothy L Maust
*Assistant Examiner* — Nicolas A Arnett
(74) *Attorney, Agent, or Firm* — Stoel Rives LLP

(57) ABSTRACT

A fuel fill port that helps prevent spillage of fuel during watercraft fueling includes a housing having an opening for installation on a surface of the watercraft and a cap for sealing the opening. A fill tube has one end sized to accept a fuel dispensing nozzle and another end for connection to a fuel tank. A catch basin defined by a bottom portion of the housing is positioned such that backflow of fuel from the fill tube collects within the catch basin. A fill vent has one end positioned relative the fill tube to allow excess fuel from the fuel tank to flow into the catch basin and another end adapted for connection to the fuel tank. One or more passages from the catch basin to the fuel tank guides fuel from the catch basin to the fuel tank.

21 Claims, 6 Drawing Sheets

WATERCRAFT FUELING APPARATUS AND METHODS

TECHNICAL FIELD

This disclosure relates to devices and methods of fueling watercraft designed to help prevent the spillage of fuel that might result, for example, from back splash from a fill tube or overfilling a fuel tank.

BACKGROUND INFORMATION

Fueling watercraft commonly results in a spillage of fuel that can harm marine life, generate a risk of fire, and damage the watercraft. For example, because fuel vapors are heavier than air they can rapidly spread into compartments of the watercraft. These vapors may be ignited upon reaching open flames or by starting the engine(s) or operating an electrical switch. In addition, a sheen of fuel sometimes seen on surface water near watercraft is a contaminant to people in or using the water and has a damaging impact on marine life. For these reasons, such spillage may result in stiff fines assessed to an operator.

The causes of spillage are many. By way of example, if the tank is overfilled, fuel may spill out of a fill tube connected to the tank or escape from a vent tube that provides venting for the tank. In addition, sudden movement of the watercraft may cause spillage, such as movement generated by a wave from a passing watercraft or a passenger jumping between the watercraft and a dock. Thus, fueling a watercraft is more challenging than fueling a still vehicle on land.

Various devices and methods have been proposed to prevent spillage. For example, the operator may purposefully underfill the fuel tank, e.g., pumping only 25 gallons of fuel knowing the watercraft has a 30-gallon tank. Unfortunately, this may result in reduced range. As another example, the operator may wedge a rag between the nozzle and a fuel port. However, this may not only leave the operator with the task of properly disposing of a contaminated rag, but may also prevent the fuel vapors from properly escaping. Yet another example is the fuel overflow prevention device disclosed in U.S. Pat. No. 5,894,809 to Grigaitis, which discloses a reservoir interposed between a fuel tank vent tube and an air vent port. The reservoir collects overflowing fuel from the fuel tank and returns it to the fuel tank. However, Grigaitis is unable to capture fuel exiting from a top of the fill tube, such as back splash. In addition, fuel may actually exit Grigaitis' air vent port before the operator is aware that the tank is full.

SUMMARY OF THE DISCLOSURE

According to one embodiment, a fuel fill port on a surface of a watercraft comprises an opening in the fill port, a removable cap covering and sealing said opening, a main fill tube, a catch basin, an overflow tube, and an opening from the catch basin to the main fill tube positioned to permit drainage of the contents of the catch basin into the main fill tube. The main fill tube has an open top end positioned proximate to and below said opening. The main fill tube also has a distal end for connecting to a fuel tank and is sized to accept therein a fuel dispensing nozzle inserted through said opening. The catch basin has an open top positioned below said opening such that back splash of fuel from the main fill tube is collected within the catch basin. The overflow tube is connected between the fuel tank and the catch basin such that excess fuel in the fuel tank is conveyed via the overflow tube into the catch basin.

According to another embodiment, a fuel fill port comprises a housing for installation on a surface of a watercraft. The housing has an opening proximate the surface. A cap is removably coupled to the housing for sealing the opening. A fill tube extends through the housing and a first end of the fill tube is sized to accept a fuel dispensing nozzle and a second end of the fill tube is adapted for connection to a fuel tank. A catch basin is defined by a bottom portion of the housing and is positioned relative the opening and the first end of the fill tube such that backflow of fuel from the fill tube collects within the catch basin. A fill vent extends through the housing, and a first end of the fill vent is positioned relative the first end of the fill tube to allow excess fuel from the fuel tank to flow into the catch basin and a second end of the fill vent is adapted for connection to the fuel tank. A passage from the catch basin to the fuel tank guides fuel from the catch basin to the fuel tank.

According to still another embodiment, a method fuels a fuel tank of a watercraft through a fill port, which comprises an access opening, a main fill tube connected to a fuel tank having an open top end positioned proximate to and below said opening, a catch basin having an open top and positioned peripherally from said main fill tube, an overflow tube connected between said fuel tank and said catch basin, and a drain opening from said catch basin to said main fill tube. The method for fueling the fuel tank of a watercraft through the fill port involves accepting fuel into said fuel tank via said main fill tube, retaining a back splash of fuel from said main fill tube in said catch basin, draining said back splash of fuel retained in said catch basin into said fuel tank through said drain opening and said main fill tube, venting air displaced in said fuel tank through said overflow tube and externally from said watercraft, transporting any excess of fuel in said fuel tank to said catch basin via said overflow tube, retaining said excess of fuel from said fuel tank in said catch basin, and draining said excess of fuel retained in said catch basin into said fuel tank through said drain opening and said main fill tube.

Additional aspects and advantages of this disclosure will be apparent from the following detailed description of preferred embodiments, which proceeds with reference to the accompanying drawings.

DETAILED DESCRIPTION OF EMBODIMENTS

With reference to the above-listed drawings, this section describes particular embodiments and their detailed construction and operation. The embodiments described herein are set forth by way of illustration only. Those skilled in the art will recognize in light of the teachings herein that variations can be made to the embodiments described herein and that other embodiments are possible. No attempt is made to exhaustively catalog all possible embodiments and all possible variations of the described embodiments.

For the sake of clarity and conciseness, certain aspects of components or steps of certain embodiments are presented without undue detail where such detail would be apparent to those skilled in the art in light of the teachings herein and/or where such detail would obfuscate an understanding of more pertinent aspects of the embodiments.

As one skilled in the art will appreciate in view of the teachings herein, certain embodiments may be capable of achieving certain advantages, including by way of example and not limitation one or more of the following: (1) preventing spillage of fuel during watercraft fueling; (2) preventing the contamination of waterways resulting from fuel spillage; (3) preventing harm to marine organisms and people caused by spillage; (4) avoiding fines assessed to a watercraft operator resulting from spillage; (5) minimizing the risk of fire due to fuel spillage; (6) avoiding damage to the watercraft based on spillage; (7) providing for increased range of the watercraft by more fully filling a fuel tank; (8) minimizing the risk of confusing the fuel fill port with a water fill port; (9) capturing fuel exiting from a top of a fill tube; and (10) preventing fuel from exiting a vent port. These and other advantages of various embodiments will be apparent upon reading the following.

Figure 1:
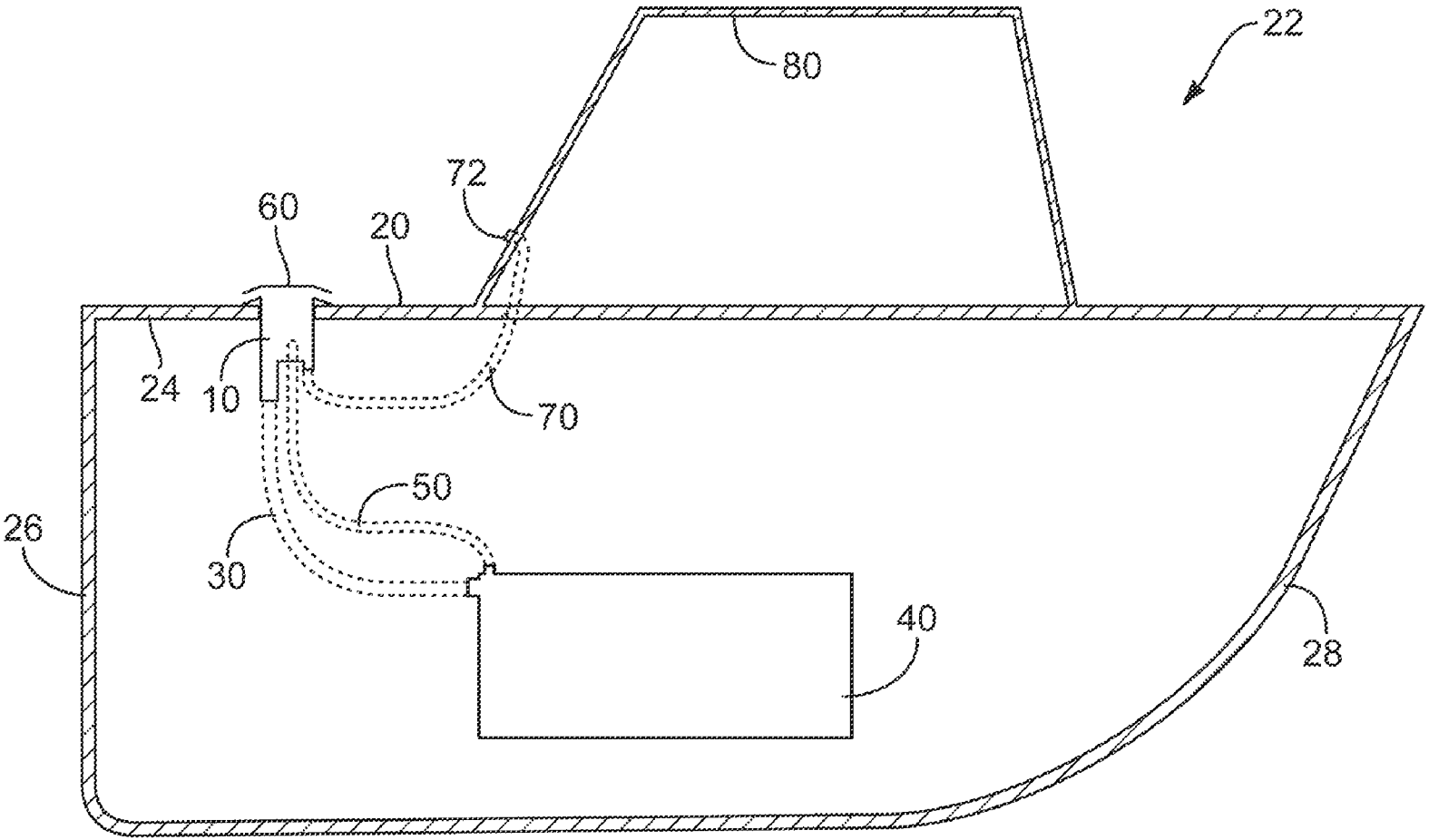
FIG. 1 is a pictorial view of a watercraft having a fuel fill port according to one embodiment.

FIG. 1 illustrates a fuel fill port 10 installed on a surface 20 of a watercraft 22. While fueling, a fuel filler tube 30 transports fuel from the fill port 10 to a tank 40. An overflow tube 50 allows air and fuel vapors displaced by the fuel to escape via the fill port 10. In addition, the overflow tube 50 allows excess fuel from the tank 40 to collect in the fill port 10 as further described with reference to FIGS. 2-6. After fueling, a cap 60 can cover and seal the fill port 10. To prevent pressure from building within the tank 40, the fill port 10 permits air and fuel vapors to escape from the tank 40 via a breather vent line 70 and a breather port 72. While the breather port 72 is shown installed in a cabin house 80, the breather port 72 may be installed in other locations, such as the surface 20, deck 24, stern 26, bow 28, or a port or starboard side of the watercraft 22. Installing the breather port 72 above the fuel fill port 10 may help prevent fuel from exiting the breather port 72 by allowing the user to see when the tank 40 is full.

Figure 2:
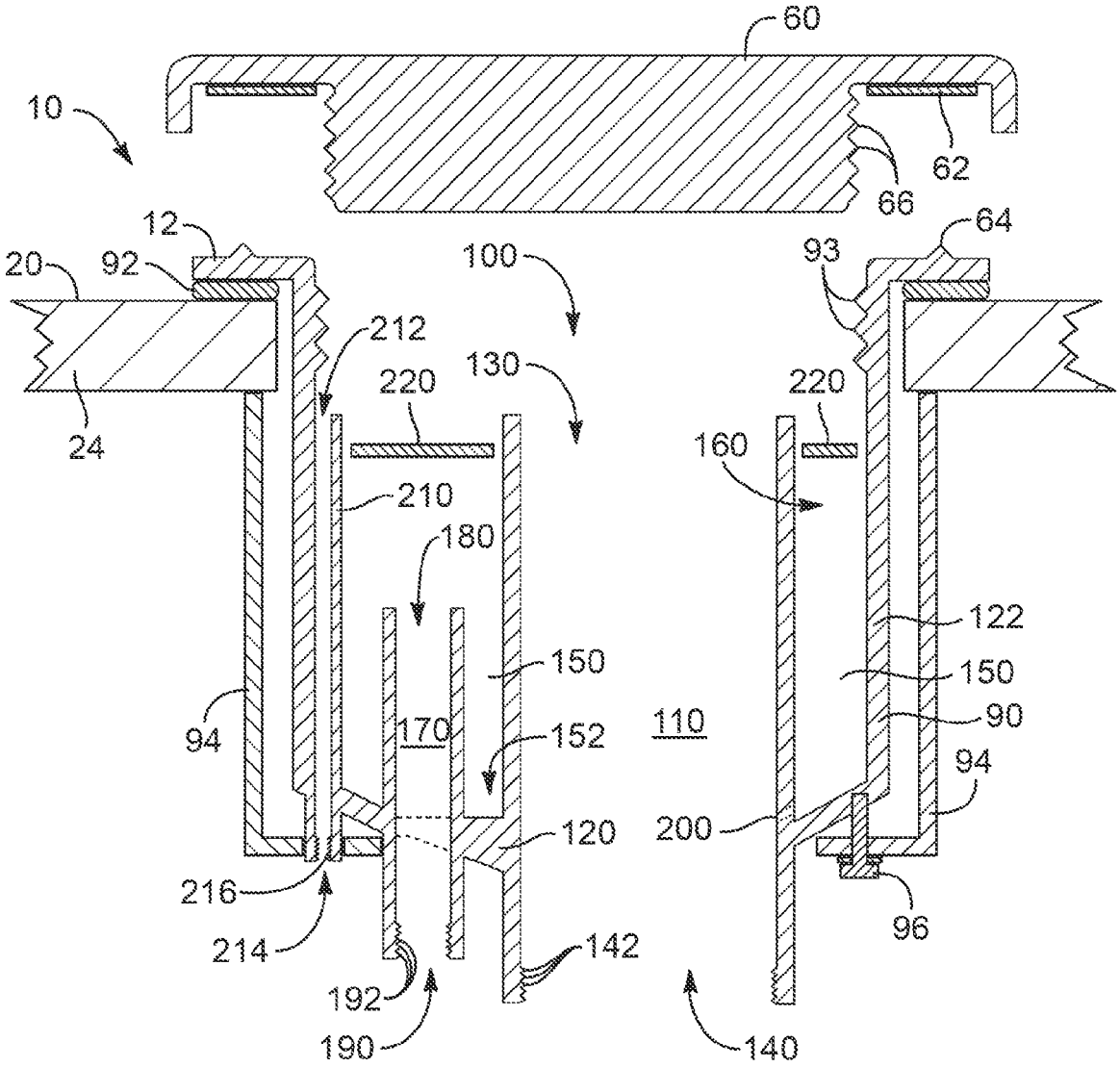
FIG. 2 is a side view of the fuel fill port of FIG. 1.
Figure 3:
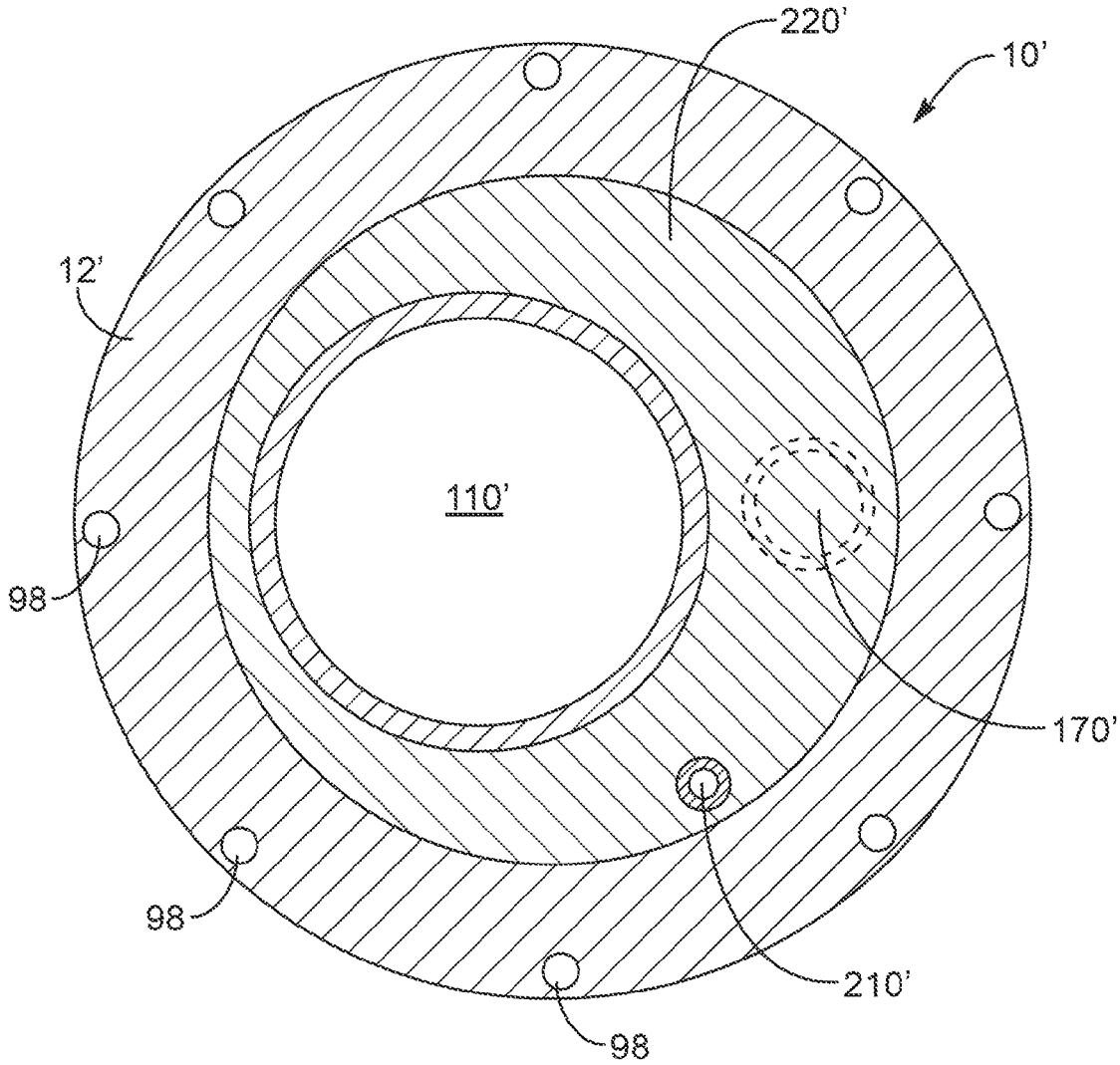
FIG. 3 is a top plan view of a fuel fill port according to another embodiment.

Referring now to FIGS. 2 and 3, the fill port 10 includes a housing 90 for installation on the surface 20. The housing 90 may be cast molded from metal, such as brass, steel, aluminum, and alloys. Alternatively, the housing 90 may be formed from other materials, such as plastic, and may take shapes other than that shown. In order to seal the housing 90 to the surface 20, a gasket 92 may be provided. The gasket 92 may be constructed from, for example, elastomer materials such as rubber, neoprene, cork, or polytetrafluorethylene (PTFE). FIG. 2 illustrates the housing 90 anchored to the watercraft 22 according to one embodiment. A bolt 96 is threaded into the housing 90 to secure the housing 90 to a securing skirt 94. In addition, other mounting devices and methods may be used, such as a clamp, pin, or rivet. Alternatively, the housing 90 may snap into the securing skirt 94. FIG. 3 illustrates the housing 90 secured to the watercraft 22 according to another embodiment. As shown in FIG. 3, securing holes 98 are provided through a lip 12 of the fill port 10. Bolts (not shown) inserted through securing holes 98 help mount the fill port 10 flush to the surface 20. Other fasteners, such as screws, rivets, and wedge anchors may also be used.

The cap 60 is removably coupled to the housing 90 for covering and sealing an opening 100. In one embodiment, a gasket 62 and a ridge 64 are provided to ensure a tight seal. The gasket 62 may be constructed from elastomer materials such as rubber, neoprene, cork, or polytetrafluorethylene (PTFE). As illustrated in FIG. 2, threads 66 are formed on the cap 60 and sized to mate with threads 93 formed on the housing 90. However, the cap 60 may be coupled to the housing 90 using other methods. For example, one or more pins may be formed on the cap 60 for mating with slots formed in the housing 90 or vice versa. In addition, the cap 60 may be sized to snugly fit within the opening 100 so that friction holds the cap 60 to the housing 90. The cap 60 may be substantially larger than a water port (not shown) on the watercraft 22. The size difference helps avoid the hazards and costs associated with inadvertently pouring fuel into a water tank (not shown) in the watercraft 22. In addition, the cap 60 may include identifying colors or symbols to signify fuel, such as DIESEL FUEL ONLY or GASOLINE ONLY. The cap 60 may be cast molded from metal, such as steel, aluminum, and alloys. Alternatively, the cap 60 may be formed from other materials, such as plastic.

In one embodiment, a main fill tube 110 extends through a bottom portion 120 of the housing 90. The main fill tube 110 may have an open top end 130 positioned proximate to and below the opening 100 and sized to accept a fuel dispensing nozzle (not shown) inserted through the opening 100. A distal end 140 of the main fill tube 110 is adapted for connection to the tank 40. For example, threads 142 may be provided and sized to accept various fuel filler tubes 30 and coupling sizes. Additionally, a band clamp (not shown) may be fitted over the fuel filler tube 30 and tightened to secure the fuel filler tube 30 to the main fill tube 110. Further, the fuel filler tube 30 may be sized to form a friction fit between the fuel filler tube 30 and the main fill tube 110. The main fill tube 110 may be formed from the same or different material as the housing 90. A main fill tube cover (not shown) may be hinged to open the top end 130 of the main fill tube 110 to prevent fuel from escaping the main fill tube 110 when the watercraft 22 is in use.

A catch basin 150 is defined by the bottom portion 120 of the housing 90 and sidewalls 122 of the housing 90, according to one embodiment. The catch basin 150 is positioned relative the opening 100 and the open top end 130 of the main fill tube 110 so that backflow or back splash of fuel from the main fill tube 110 collects within the catch basin 150. For example, the catch basin 150 may have an open top 160 positioned below the opening 100. The catch basin 150 may be positioned peripherally from the main fill tube 110 and may partially or entirely surround the main fill tube 110. The amount of fuel that the catch basin 150 holds may depend on several factors, such as the fuel fill rate, human reaction time, and typical back splash volumes. In some embodiments, the catch basin 150 holds between about 8 ounces and about 32 ounces of fuel, but this can vary based upon the application.

According to one embodiment, a fill vent 170 extends through the bottom portion 120 of the housing 90 and is substantially parallel to the main fill tube 110. An open top end 180 of the fill vent 170 may be positioned relative the open top end 130 of the main fill tube 110 to allow excess fuel from the tank 40 to flow into the catch basin 150 via the fill vent 170. For example, the open top end 180 of the fill vent 170 may be below the open top end 130 of the main fill tube 110. According to some embodiments, the fill vent 170 is located between about 0.125 and about 0.75 inches below the open top end 130 of the main fill tube 110, but this can vary based upon the application. In addition, the fill vent 170 may be positioned near a bottom portion 152 of the catch basin 150 and may extend in a direction toward an open top 160 of the catch basin 150. Alternatively, the fill vent 170 may extend into the catch basin 150 laterally. In one embodiment, a bottom end 190 of the fill vent 170 is adapted for connection to the tank 40. For example, the fill vent 170 may be in communication with the overflow tube 50 such that excess fuel in the tank 40 is conveyed via the overflow tube 50 into the catch basin 150. In another embodiment, the overflow tube 50 is connected between the tank 40 and the housing 90 proximate the catch basin 150, such as through the side wall 122 or the bottom portion 120. Threads 192 may be provided and sized to accept various overflow tubes 50 and coupling sizes. Alternatively, a band clamp (not shown) may be fitted over the overflow tube 50 and tightened to secure the overflow tube 50 to the fill vent 170. In addition, the overflow tube 50 may be sized to form a friction fit between the overflow tube 50 and the fill vent 170. The fill vent 170 may be formed from the same or different material as the housing 90. The overflow tube 50 may be formed from metals such as steel, brass, iron, or alloys or formed from other materials, such as plastics.

In one embodiment, the catch basin 150 is able to guide fuel to the tank 40. For example, one or more openings 200 may be provided from the catch basin 150 to the main fill tube 110 and positioned to permit drainage of the contents of the catch basin 150 into the main fill tube 110. The main fill tube 110 in turn can transport the contents to the tank 40 via the fuel filler tube 30. In another embodiment, one or more openings (not shown) may be provided from the catch basin 150 to fill the vent 170 to permit drainage of the contents of the catch basin 150 into the tank 40 via the overflow tube 50. The fuel filler tube 30 may be formed from the same or different material as the overflow tube 50.

A breather vent 210 may be positioned within the opening 100 and in communication with the breather port 72 (FIG. 1) to permit air and fuel vapors to flow from the tank 40 externally from the watercraft 22 via the breather port 72 when the cap 60 seals the opening 100. For example, the breather vent 210 may extend through the housing 90, such as through the side wall 122 or the bottom portion 120, and an open top end 212 of the breather vent 210 may terminate proximate the opening 100. A bottom end 214 of the breather vent 210 may be adapted for connection to the breather port 72. For example, threads 216 may be provided and sized to accept various breather vent lines 70 and coupling sizes. Alternatively, a band clamp (not shown) may be fitted over the breather vent line 70 and tightened to secure the breather vent line 70 to the breather vent 210. Further, the breather vent line 70 may be sized to form a friction fit between the breather vent line 70 and the breather vent 210. The breather vent 210 may be formed from the same or different material as the housing 90. The breather vent line 70 may be formed from metals such as steel, brass, iron, or alloys or formed from other materials, such as plastics.

A back splash cover 220 may be positioned within the catch basin 150 and above the fill vent 170 to prevent excess fuel from escaping from the open top 160 of the catch basin 150. In one embodiment, the back splash cover 220 is approximately 0.5 inches below the open top end 130 of the main fill tube 110 and approximately 1.0 inches below the open top end 212 of the breather vent 210. However, the dimensions can vary based upon the application. A breathable material, such as a mesh of metal, plastic, or cloth, may be used to make the back splash cover 220. However, the back splash cover 220 could also be a solid material with holes (not shown) for drainage formed therein. For example, the back splash cover 220 could be integral with the housing 90. In addition, the back splash cover 220 could be secured to the housing 90 or resting on a lip formed in the housing 90. The back splash cover 220 could be made from the same or different material as the housing 90.

With reference to FIG. 3, a fuel fill port 10' according to another embodiment has securing holes 98 provided through the lip 12' of the fill port 10'. (in FIG. 3 reference numerals with the prime symbol, e.g., 10', indicate elements similar to those of the same name in the first embodiment, i.e., the fuel fill port 10). The lip 12' may be sized to provide adequate room to accommodate fasteners installed through securing holes 98 and be stiff enough to prevent motion of the fill port 10' relative to the watercraft 22. As previously described, the main fill tube 110' and the breather vent 210' extend through the back splash cover 220'. However, the fill vent 170' is underneath the back splash cover 220'. As can be seen by comparing FIGS. 2 and 3, the relative positions of the main fill tube 110', the breather vent 210' and the fill vent 170' may vary. For example, the breather vent 210' is shown integrally formed with the sidewall 122 of the housing 90 in FIG. 2, but is shown detached from the sidewall 122 of the housing 90 in FIG. 3.

Figure 4:
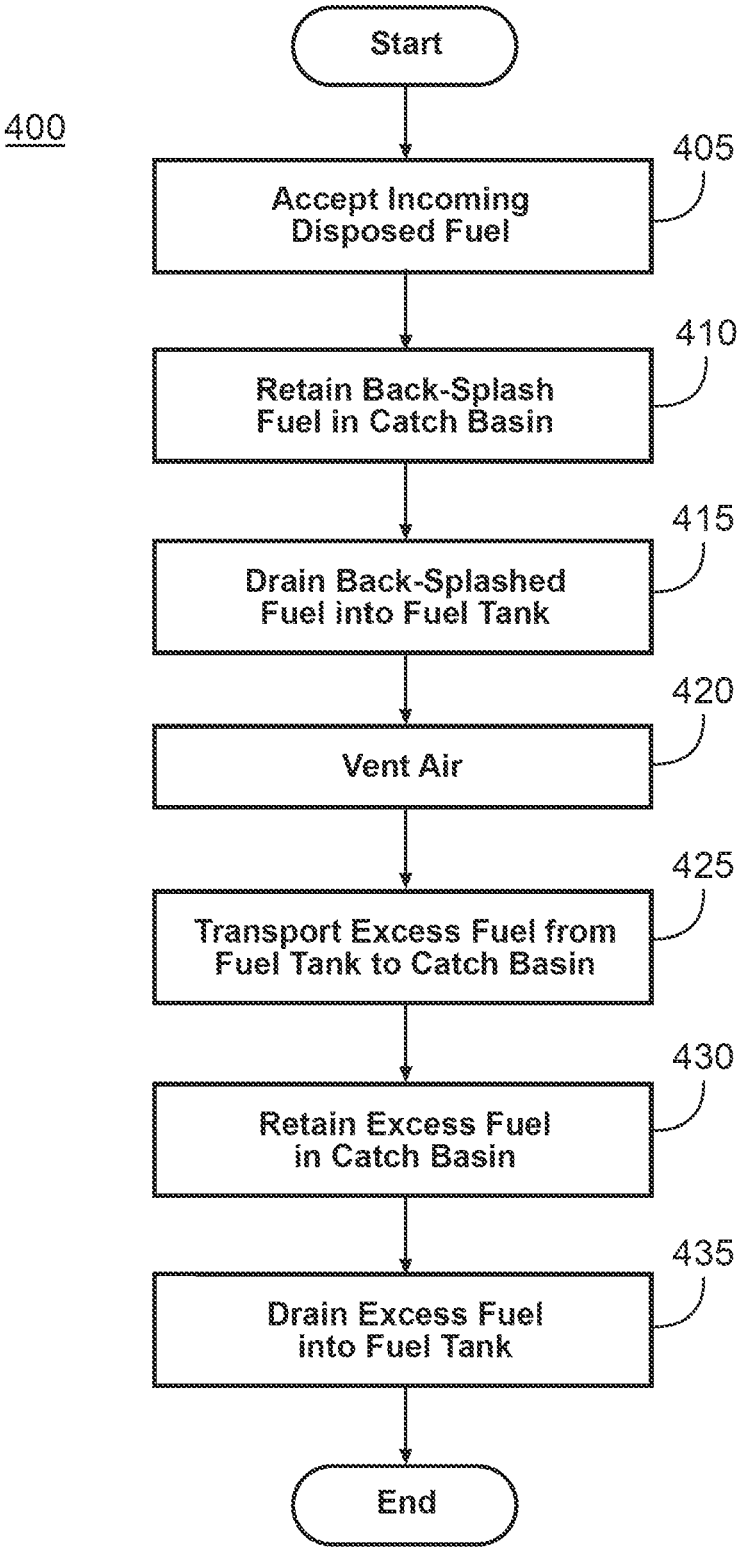
FIG. 4 is a flow chart for a method of fueling a watercraft fuel tank, according to one embodiment.
Figure 5:
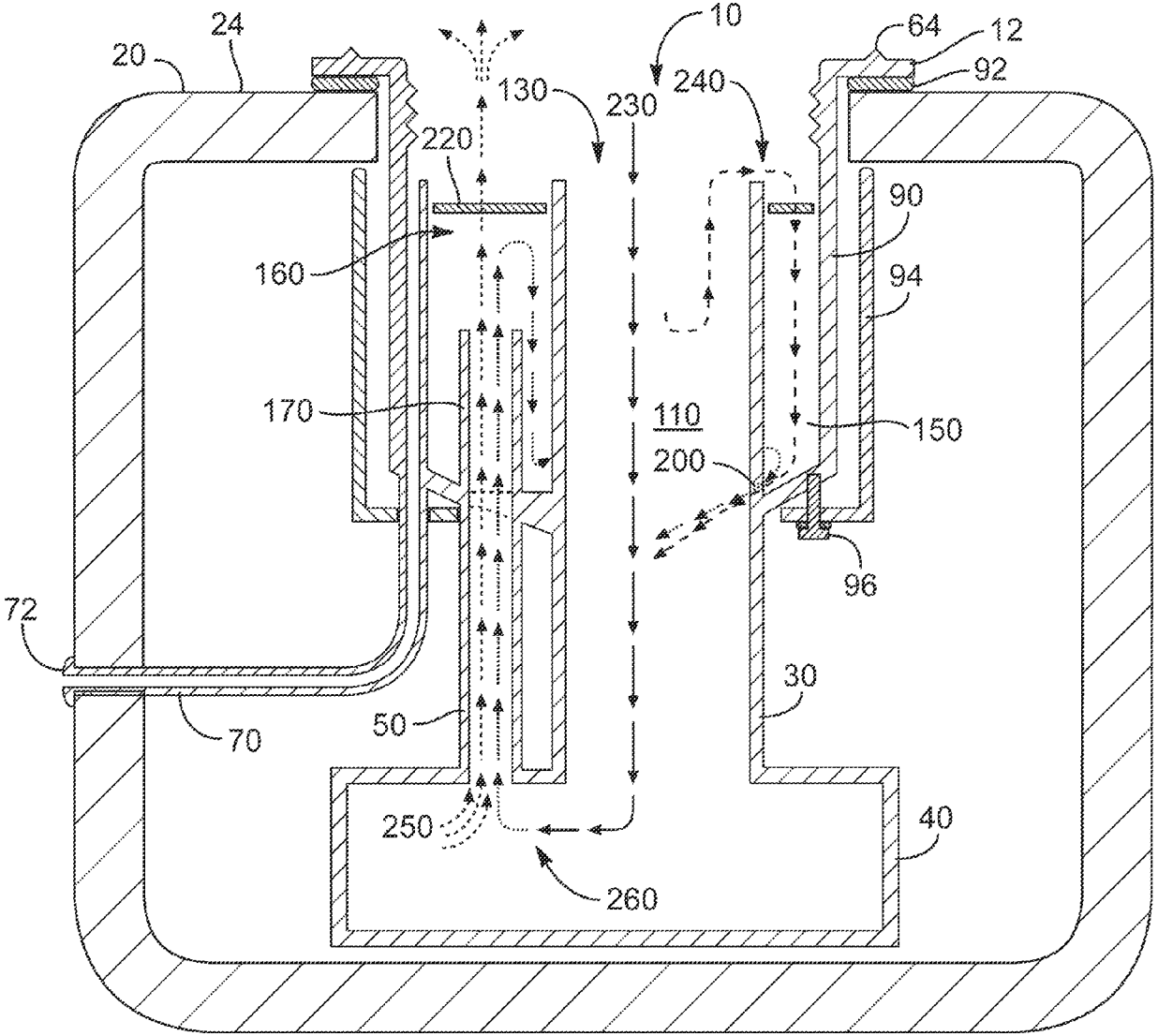
FIG. 5 is a partial cross-section of the watercraft and fuel fill port of FIG. 1 illustrating fuel flow and displaced air flow.
Figure 6:
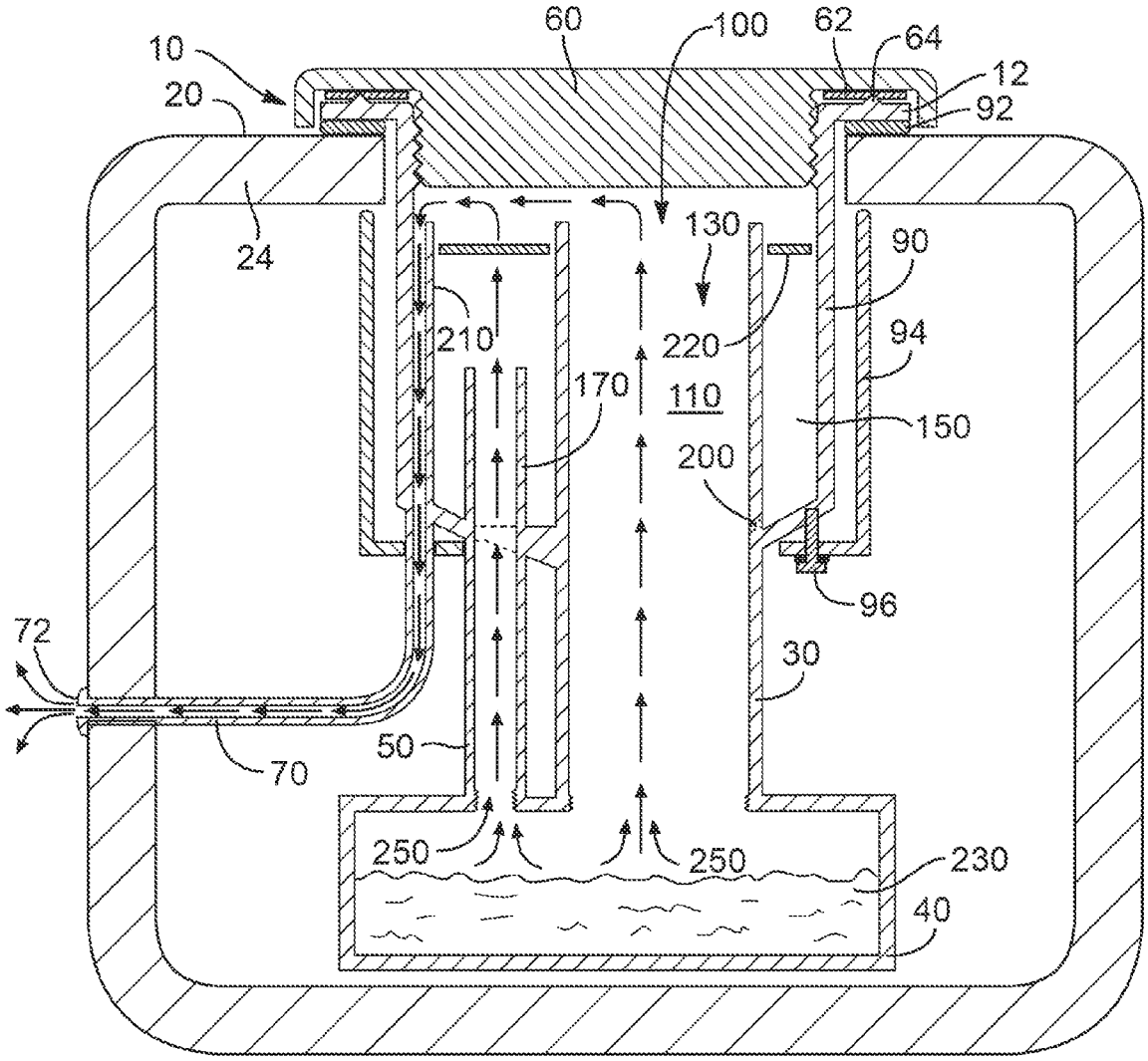
FIG. 6 is a partial cross-section of the watercraft and fuel fill port of FIG. 1 illustrating air flow when a removable cap is installed.

Referring now to FIGS. 4, 5, and 6, a method 400 of fueling the watercraft 22 utilizing the fuel fill port 10 or similar fuel fill port, according to one embodiment, is described. After removing the cap 60, a nozzle or other fuel dispensing object may be inserted through opening 100 and into the open top end 130 of the main fill tube 110. At step 405, the tank 40 accepts incoming fuel 230 from the nozzle via the main fill tube 110. While fueling the watercraft 22, the fuel 230 may exit the main fill tube 110 from the open top end 130. For example, the fuel 230 may reflect off a portion of the main fill tub 110. In addition, sudden movement of the watercraft 22, such as that caused by a wave or a passenger jumping off the watercraft 22, may cause the fuel 230 to splash back from the main fill tube 110. At step 410, the catch basin 150 retains back-splash fuel 240 from the main fill tube 110. For example, the back-splash fuel 240 can pass through the back-splash cover 220 into the catch basin 150. At step 415, one or more openings 200 drains the back-splash fuel 240 retained in the catch basin 150 into the tank 40 via the fuel filler tube 30.

Pressure may build in the tank 40 as the fuel 230 enters and causes the displaced air 250 (e.g., air and fuel vapors) to exit the tank 40. At step 420, the overflow tube 50 vents the displaced air 250 in the tank 40 into the catch basin 150 and then externally from the fuel fill port 10 and the watercraft 22.

At step 425, the overflow tube 50 transports the excess fuel 260 from the tank 40 to the catch basin 150, such as when the tank 40 is overfilled. At step 430, the catch basin 150 retains the excess fuel 260 from the tank 40. In one embodiment, the back-splash cover 220 is positioned within the catch basin 150 above the fill vent 170 to prevent the excess fuel 260 from escaping the open top 160 of the catch basin 150. The back splash cover 220 may be solid or non-porous directly above the fill vent 170. At step 435, one or more openings 200 drain the excess fuel 260 retained in the catch basin 150 into the tank 40 via main fill tube 110 and the fuel filler tube 30 or holds it there until the tank 40 can accept it.

With reference to FIG. 5, when the cap 60 covers and seals opening 100, pressure may build within the tank 40 and the fuel fill port 10. For example, the fuel 230 may be colder than the ambient air temperature, especially if the fuel 230 was pumped from an underground storage tank or the fuel 230 cooled overnight. As the fuel 230 adjusts to the ambient air temperature, pressure may build within the tank 40 and the fuel fill port 10. In addition, as the watercraft 22 moves and jostles the fuel 230 within the tank 40, the fuel 230 may release vapors that build pressure within the tank 40 and the fuel fill port 10. The breather vent 210, the breather vent line 70, and the breather port 72 vent displaced the air 250 in the tank 40 and the fuel fill port 10 to the environment.

The fuel fill port 10 may be used on various watercrafts 22, such as a yacht, recreational boat, personalized watercraft (e.g., jet-ski™), pleasure craft, jet boat, fishing boat, sail boat, military ship, amphibious landing craft, cruise ship, or shipping vessel. In addition, the fuel fill port 10 may be used on a vehicle, such as a car, motorcycle, train, ship, or aircraft. Further, the fuel fill port 10 may be installed when the watercraft 22 is being fabricated or the fuel fill port 10 may be retrofit into an existing watercraft. While the fuel filler tube 30 and the overflow tube 50 are shown connected directly to the tank 40, any number of devices, such as a fuel pump, may be installed between the fuel fill port 10 and the tank 40.

The terms and descriptions used herein are set forth by way of illustration only and are not meant as limitations. Those skilled in the art will recognize that many variations can be made to the details of the above-described embodiments without departing from the underlying principles of the invention. The scope of the invention should therefore be determined only by the following claims (and their equivalents) in which all terms are to be understood in their broadest reasonable sense unless otherwise indicated.

The invention claimed is:

1. A fuel fill port on a surface of a watercraft, the fill port comprising:

an opening in the fill port;

a removable cap covering and sealing said opening;

a main fill tube having an open top end positioned proximate to and below said opening, the main fill tube also having a distal end for connecting to a fuel tank, the main fill tube sized to accept therein a fuel dispensing nozzle inserted through said opening;

a catch basin having an open top positioned below said opening such that back splash of fuel from the main fill tube is collected within the catch basin;

an overflow tube connected between the fuel tank and the catch basin such that excess fuel in the fuel tank is conveyed via the overflow tube into the catch basin;

a fill vent positioned near a bottom portion of said catch basin and extending in a direction towards said open top of said catch basin, wherein said fill vent is in communication with said overflow tube;

a back splash cover positioned within said catch basin and above said fill vent to prevent said excess fuel from escaping from said open top of said catch basin; and an opening from the catch basin to the main fill tube positioned to permit drainage of the contents of the catch basin into the main fill tube.

2. A fuel fill port according to claim 1, further comprising:

a tank breather vent positioned within said opening and in communication with a breather port to permit air to flow from said fuel tank and externally from said watercraft when said removable cap is sealing said opening.

3. A fuel fill port according to claim 1, wherein said back splash cover comprises a breathable material.

4. A fuel fill port according to claim 1, further comprising:

a plurality of openings from said catch basin to said main fill tube positioned to permit drainage of the contents of the catch basin into the main fill tube.

5. A fuel fill port according to claim 1, wherein said catch basin is positioned peripherally from said main fill tube.

6. A fuel fill port according to claim 5, wherein said peripheral position of said catch basin is a position where said catch basin entirely surrounds said main fill tube.

7. A fuel fill port according to claim 5, wherein said peripheral position of said catch basin is a position where said catch basin partially surrounds said main fill tube.

8. A fuel fill port according to claim 1, wherein said removable cap comprises an identification to signify fuel.

9. A watercraft comprising a fuel fill port according to claim 1.

10. A fuel fill port according to claim 1, wherein an open top end of the fill vent is positioned below the open top end of the main fill tube.

11. A method for fueling a fuel tank of a watercraft through a fill port, said fill port comprising an access opening, a main fill tube connected to said fuel tank having an open top end positioned proximate to and below said opening, a catch basin having an open top and positioned peripherally from said main fill tube, an overflow tube connected between said fuel tank and said catch basin, a fill vent in communication with said overflow tube, said fill vent positioned near a bottom portion of said catch basin and extending in a direction towards said open top of said catch basin, and a drain opening from said catch basin to said main fill tube, the method comprising:

accepting fuel into said fuel tank via said main fill tube;

retaining a back splash of fuel from said main fill tube in said catch basin;

draining said back splash of fuel retained in said catch basin into said fuel tank through said drain opening and said main fill tube;

venting air displaced in said fuel tank through said overflow tube and externally from said watercraft;

transporting any excess of fuel in said fuel tank to said catch basin via said overflow tube;

retaining said excess of fuel from said fuel tank in said catch basin;

preventing said excess of fuel from escaping from said open top of said catch basin via a back splash cover positioned within said catch basin and above said fill vent; and draining said excess of fuel retained in said catch basin into said fuel tank through said drain opening and said main fill tube.

12. A method according to claim 11, wherein said fill port further comprises a removable cap for covering and sealing said access opening and a tank breather vent positioned within said access opening and in communication with a breather port, wherein said venting step further comprises:

venting said displaced air in said fuel tank through said tank breather vent and said breather port when said removable cap is covering and sealing said access opening.

13. A method according to claim 11, wherein said back splash cover comprises a breathable material.

14. A fuel fill port comprising:

a housing for installation on a surface of a watercraft, the housing having an opening proximate the surface;

a cap removably coupled to the housing for sealing the opening;

a fill tube extending through the housing, a first end of the fill tube sized to accept a fuel dispensing nozzle and a second end of the fill tube adapted for connection to a fuel tank;

a catch basin defined by a bottom portion of the housing and positioned relative the opening and the first end of the fill tube such that backflow of fuel from the fill tube collects within the catch basin;

a fill vent extending through the housing, a first end of the fill vent positioned relative the first end of the fill tube to allow excess fuel from the fuel tank to flow into the catch basin and a second end of the fill vent adapted for connection to the fuel tank;

a back splash cover positioned over a top portion of the catch basin and above the fill vent to prevent the excess fuel from escaping a top portion of the catch basin; and a passage from the catch basin to the fuel tank for guiding fuel from the catch basin to the fuel tank.

15. A fuel fill port according to claim 14, further comprising:

a breather vent extending through the housing, a first end of the breather vent adapted for connection to a breather port and a second end of the breather vent terminating proximate the opening to allow air to escape through the breather port when the cap seals the opening.

16. A fuel fill port according to claim 14, wherein the fill tube and fill vent extend through the bottom portion of the housing and are substantially parallel to one another.

17. A fuel fill port according to claim 14, wherein the first end of the fill vent is below the first end of the fill tube.

18. A fuel fill port according to claim 14, wherein the passage from the catch basin to the fuel tank comprises a plurality of openings from said catch basin to said fill tube and positioned to permit drainage of the contents of the catch basin into the fill tube.

19. A fuel fill port according to claim 14, wherein said catch basin is positioned peripherally from said fill tube.

20. A fuel fill port according to claim 14, wherein said back splash cover comprises a breathable material.

21. A fill port for fueling a fuel tank of a watercraft, the fill port comprising:

means for accepting fuel and conveying said fuel into the fuel tank;

means for retaining a back splash of fuel; means for venting air displaced in said fuel tank externally from the watercraft;

means for transporting an excess of fuel in the fuel tank to said means for retaining a back splash of fuel;

means for preventing said excess of fuel from escaping a top portion of said means for retaining a back splash of fuel; and means for draining said back splash of fuel and said excess of fuel back into the fuel tank.

* * * * *